US008354046B2

(12) United States Patent
Jia et al.

(10) Patent No.: US 8,354,046 B2
(45) **Date of Patent: *Jan. 15, 2013**

(54) GERMANIUM FILMS BY POLYMER-ASSISTED DEPOSITION

(75) Inventors: Quanxi Jia, Los Alamos, NM (US); Anthony K. Burrell, Los Alamos, NM (US); Eve Bauer, Los Alamos, NM (US); Filip Ronning, Los Alamos, NM (US); Thomas Mark McCleskey, Los Alamos, NM (US); Guifu Zou, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 566 days.

This patent is subject to a terminal disclaimer.

(21) Appl. No.: 12/558,314

(22) Filed: Sep. 11, 2009

(65) Prior Publication Data

US 2010/0029069 A1 Feb. 4, 2010

Related U.S. Application Data

(63) Continuation-in-part of application No. 10/888,868, filed on Jul. 8, 2004, now Pat. No. 7,604,839.

(51) Int. Cl.
*H01B 1/02* (2006.01)

(52) U.S. Cl. ..... 252/518.1; 524/401; 528/480; 528/502 A; 106/1.05; 106/401

(58) Field of Classification Search ..... 252/518.1; 524/401; 528/480, 502 A; 106/1.05, 401
See application file for complete search history.

(56) References Cited

U.S. PATENT DOCUMENTS 5,258,200 A * 11/1993 Mayernik ..... 427/8
2005/0008777 A1 * 1/2005 McCleskey et al. ..... 427/226

OTHER PUBLICATIONS

Zhou et al., "Heteroepitaxial Growth of Ge Films on Si Substrates by Molecular Beam Epitaxy," Applied Physics Letters, vol. 53, No. 22 (Nov. 1988) pp. 2179-2181.
Colace et al., "Efficient High-Speed Near-Infrared Ge Photodetectors Integrated on Si Substrates," Applied Physics Letters, vol. 76, No. 10 (Mar. 2000) pp. 1231-1233.
Bean, "Strained-Layer Epitaxy of Germanium-Silicon Alloys," Science, vol. 230, No. 4722 (Oct. 1985) pp. 127-131.
Wietler et al., "Advances in Surfactant-Mediated Growth of Ge on Si: High-Quality p-type Ge Films on Si," Materials Science in Semiconductor Processing, vol. 8 (Feb. 2005) pp. 73-77.
Bolkhovityanov et al., "Potentialities and Basic Principles of Controlling the Plastic Relaxation of GeSi/Si and Ge/ Si Films with Stepwise Variation in the Composition," Semiconductors, vol. 42, No. 1 (May 2008) pp. 1-20.
Said et al., "Design, Fabrication, and Analysis of Crystalline Si-SiGe Heterostructure Thin-Film Solar Cells," IEEE Trans. Elec. Dev., vol. 46, No. 10 (Oct. 1999) pp. 2103-2110.

* cited by examiner

*Primary Examiner* — Mark Kopec
*Assistant Examiner* — Haidung Nguyen
(74) *Attorney, Agent, or Firm* — Samuel L. Borkowsky

(57) ABSTRACT

Highly ordered Ge films are prepared directly on single crystal Si substrates by applying an aqueous coating solution having Ge-bound polymer onto the substrate and then heating in a hydrogen-containing atmosphere. A coating solution was prepared by mixing water, a germanium compound, ethylenediaminetetraacetic acid, and polyethyleneimine to form a first aqueous solution and then subjecting the first aqueous solution to ultrafiltration.

3 Claims, 5 Drawing Sheets

(a)

(b)

(c)

(a) (b)

(a) (b)

GERMANIUM FILMS BY POLYMER-ASSISTED DEPOSITION

RELATED APPLICATIONS

This application is a continuation-in-part of U.S. patent application Ser. No. 10/888,868 entitled "Polymer-Assisted Deposition of Films," filed Jul. 8, 2004, now U.S. Pat. No. 7,604,839, incorporated by reference herein.

STATEMENT REGARDING FEDERAL RIGHTS

This invention was made with government support under Contract No. DE-AC52-06NA25396 awarded by the U.S. Department of Energy. The government has certain rights in the invention.

FIELD OF THE INVENTION

The present invention relates generally to the preparation of highly ordered germanium ("Ge") films on crystalline silicon ("Si") substrates.

BACKGROUND OF THE INVENTION

Both Ge and Si crystallize in the diamond structure in space group Fd3m ($a_{Ge}$=5.6576 Å; $a_{Si}$=5.4309 Å). The relatively small lattice mismatch (about 4.17%) makes it possible to grow highly ordered Ge on Si. Here highly ordered refers to the crystallographic alignments of the film along the x, y, and z directions and is very much determined by that of the crystal structure of the substrate as a result of some degree of lattice matching along the interface between the film and the substrate. Herein highly ordered germanium consists of aligned crystalline material in which the ratios of the peak intensities of (111)/(002) and the (202)/(002) Ge reflections in the θ-2θ XRD scan are <0.1 and the FWHM in the ϕ scan of the (202) reflection is <10°. Furthermore, the features of high carrier mobility and large absorption coefficient at near-infrared wavelengths make germanium ("Ge") one of the most attractive semiconductor materials for a wide variety of applications. The small bandgap of Ge, for example, makes Ge a good candidate for photodetectors and modulators at wavelengths in the range of 1.3-1.6 micrometers ("μm"). The high carrier mobility of Ge makes it the choice for high-speed transistors that have potential applications in computers and switching systems.

Ge films have been prepared using molecular beam epitaxy ("MBE") and chemical vapor deposition ("CVD"). These methods are relatively expensive, complex, and usually require a buffer layer in between the Ge layer and single crystal Si substrate to reduce lattice strain between the Ge layer and Si substrate. A simpler, less expensive method for preparing highly ordered Ge films on single crystal Si substrates is desirable.

SUMMARY OF THE INVENTION

In accordance with the purposes of the present invention, as embodied and broadly described herein, the present invention includes a method for preparing an article having highly ordered Ge on a Si substrate. The method involves applying a coating solution onto a surface of a single crystal Si substrate and then heating the coated substrate in a hydrogen containing atmosphere until a highly ordered Ge layer forms on the substrate. The coating solution is prepared by mixing together water, a germanium compound, ethylenediaminetetraacetic acid, and a polyethyleneimine to form a first aqueous solution, then subjecting the first aqueous solution to ultrafiltration.

The invention also includes a process for preparing a uniform highly ordered germanium film by applying an aqueous homogenous solution of germanium-bound polymer onto a substrate. The solution has a pH from about 4 to about 9, and is prepared by combining a solvent, a soluble germanium compound, and a soluble polymer selected from the group consisting of polyethyleneimine, carboxylated polyethyleneimine, other polyethyleneimine derivatives, polyacrylic acid, and poly(ethylene-maleic acid). The coated substrate is then heated in a hydrogen-containing atmosphere to remove the polymer and form a uniform highly ordered germanium film.

The invention is also concerned with an aqueous coating solution useful for preparing highly ordered Ge films. The coating solution is prepared by combining water, a germanium compound, ethylenediaminetetraacetic acid, and a polyethyleneimine to form a first solution. The first solution is subjected to ultrafiltration to form the aqueous coating solution.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 1*a*, the top-most pattern, shows a θ-2θ scan. FIG. 1*b*, the middle pattern, shows a rocking curve from a (004) reflection. FIG. 1*c*, the bottom pattern, shows ϕ scans from (202) reflections of both the Ge film and the Si substrate.

FIG. 2*a*, on the left, shows surface morphology of the Ge film. FIG. 2*b*, on the right, shows a three-dimensional topology image of the Ge film.

FIG. 3*a*, on the left, shows a TEM image having an inset that shows a Fast Fourier Transform ("FFT") of Ge and Si. FIG. 3*b* on the right shows a TEM image of the interface between the Ge film and the Si substrate.

DETAILED DESCRIPTION

Figure 1:
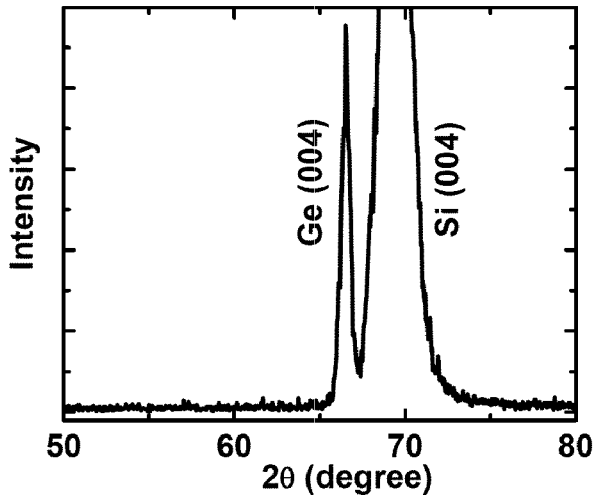
FIGS. 1*a*, 1*b*, and 1*c* show X-ray diffraction ("XRD") patterns of a highly ordered Ge film on a (001) Si substrate prepared according to an embodiment of the invention.
Figure 1:
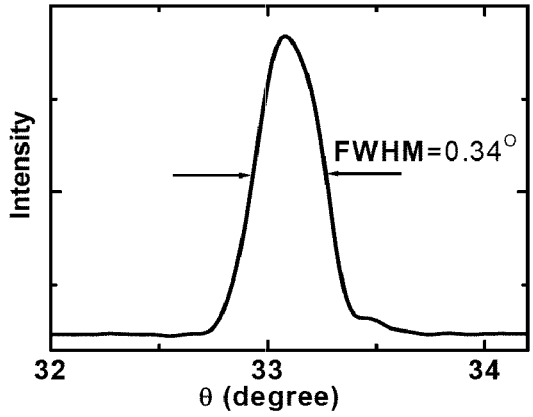
Figure 1:
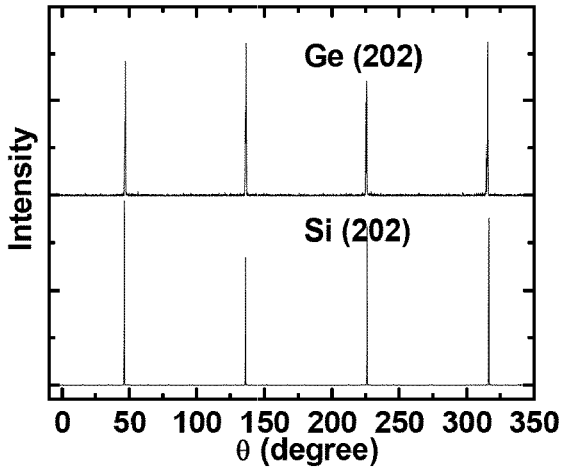

The invention is concerned with the preparation of high quality, highly ordered Ge films directly on single crystal Si substrates without a buffer layer between the Ge film and the Si substrate. The preparation involves applying a coating solution having Ge onto a Si substrate. Afterward, the coated substrate is heated under an atmosphere that contains hydrogen, which transforms the coated substrate into a high quality, highly ordered Ge film directly on the Si substrate surface.

An embodiment coating solution was prepared by combining water, a germanium compound, a polyethyleneimine ("PEI"), and ethylenediaminetetraacetic acid (EDTA") to form a first solution, and subjecting the first solution to ultrafiltration. In a particular embodiment, 2.5 grams of ethylenediaminetetraacetic acid ("EDTA") (ALDRICH, 99.995%) were added to 25 ml water purified to a measured resistivity of 18 MΩ·cm using a MILLI-Q water treatment system. High purity germanium oxide (99.99%, 1.26 g, ALDRICH) was added to the solution, and then 4 grams of polyethyleneimine ("PEI") (BASF Corporation) was added. The resulting solution was subjected to ultrafiltration using AMICON stirred cells and 10,000 molecular weight cut-off ultrafiltration membrane under 60 psi argon pressure. Unwanted materials from the solution passed through the ultrafiltration membrane, leaving the embodiment coating solution.

The Ge concentration in the coating solution was determined using an inductively coupled atomic emission ("ICP-AES") spectrometer (HORIBA JOBIN YVON ULTIMA II) following the standard SW846 EPA (Environmental Protection Agency) 6010 procedure. The analysis showed that the final germanium concentration of the coating solution was 175 millimolar ("mM").

Prior to coating the solution onto a single crystal Si (001) substrate, the substrate was cleaned for 10 minutes using a 3:1 mixture of concentrated sulfuric acid ("$H_2SO_4$") and hydrogen peroxide ("$H_2O_2$"). This treatment removed organic residues from the substrate surfaces. Afterward, the substrate was rinsed with water and dried using nitrogen gas. To remove surface oxides, the substrate was then etched for 30 minutes in 40% ammonium fluoride ("$NH_4F$") solution, and rinsed afterward for 10 minutes in deionized water. After these cleaning treatments, the coating solution having a concentration of 175 mM Ge, prepared as described above, was spin-coated onto the Si (001) substrate at 2500 rpm for 20 seconds. Afterward, the coated substrate was annealed in forming gas, consisting of 6% hydrogen in either argon or nitrogen at 900° C. for 3 hours. An SEM of the film revealed no detectable microcracks. The film was very smooth, dense, and uniform.

It will be understood by those skilled in the art that the temperature should be high enough to decompose the polymer and form highly ordered Ge from the coating solution. A temperature of 900° C. was used in the above embodiment. However, it is believed that lower temperatures would also result in highly ordered Ge. It is believed that a temperature of at least 500° C. should be used in the annealing procedure. Furthermore, forming gas, which is a gas mixture of hydrogen and an inert gas such as argon, may be replaced by pure hydrogen.

Films with a thickness in a range of 25-35 nanometers ("nm") may be obtained from one spin coat. The Ge film prepared according to the above procedure had a thickness of about 25 nm. A thicker film is possible by increasing the concentration of germanium oxide in the coating solution and/or by multiple spin-coats on the substrate.

X-ray diffraction ("XRD") was used to characterize the crystallographic orientation of the Ge film. FIGS. 1*a* through 1*c* show X-ray diffraction ("XRD") patterns of the Ge film on the (001) Si substrate. FIG. 1*a*, the top-most pattern, shows a θ-2θ scan. FIG. 1*b*, the middle pattern, shows a rocking curve from a (004) reflection. FIG. 1*c*, the bottom pattern, shows ϕ scans from (202) reflections of both the Ge film and the Si substrate. Turning to the XRD pattern of FIG. 1*a*, it can be seen that there are only (004) peaks from the Ge film and the Si substrate. The appearance of only the (004) peak of the film indicates that the Ge is preferentially oriented along the c-axis, which is the axis perpendicular to the substrate surface. No other detectable phases were observed from FIG. 1*a*. Turning next to FIG. 1*b*, a value of 0.34° for the full width at half maximum ("FWHM") of the (004) rocking curve of Ge is observed, in comparison with a value of 0.15° for the single crystal Si substrate, indicating good crystallinity of the Ge film. The in-plane orientation between the Ge film and the Si substrate was determined by XRD ϕ-scans from (202) Ge and (202) Si, respectively. As shown in FIG. 1*c*, the Ge film is aligned in-plane with respect to the substrate. An average FWHM value of 1.2° for the Ge film, as compared to a value of 0.5° for the Si substrate indicates a highly ordered film. The structural relationship between the Ge film and the Si substrate, based on FIGS. 1*a*, 1*b*, and 1*c* can be described as $(004)_{Ge}\|(004)_{Si}$ and $[202]_{Ge}\|[202]_{Si}$.

Figure 2:
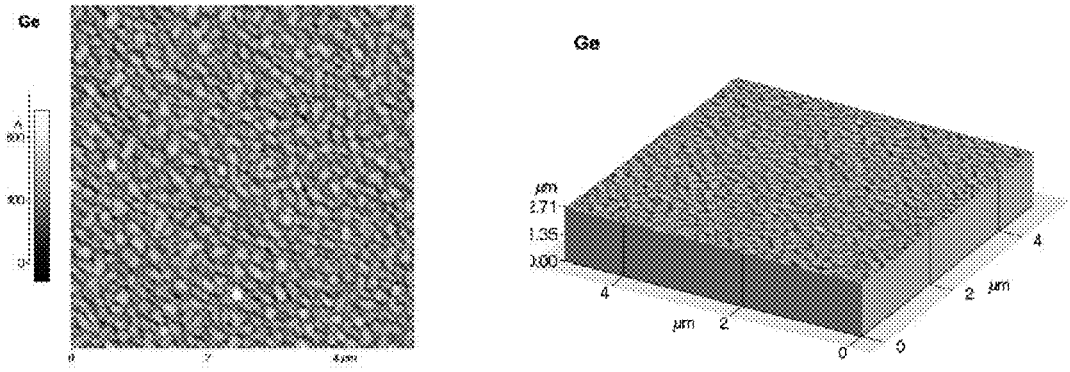
FIGS. 2*a* and 2*b* show Atomic Force Microscopy ("AFM") images of an highly ordered Ge film prepared according to an embodiment of the invention.

The surface morphology of the Ge film was characterized by atomic force microscopy ("AFM"). FIGS. 2*a* and 2*b* show AFM images of the highly ordered Ge film. FIG. 2*a*, on the left, shows the surface morphology and FIG. 2*b* on the right shows a three-dimensional topology image. As FIGS. 2*a* and 2*b* show, the Ge film has a uniform surface morphology with a homogeneous grain size of approximately 80 nm across a scan area of approximately 5×5 $\mu m^2$. The root-mean-square ("rms") surface roughness of a 25 nm thick Ge is around 3 nm.

Figure 3:
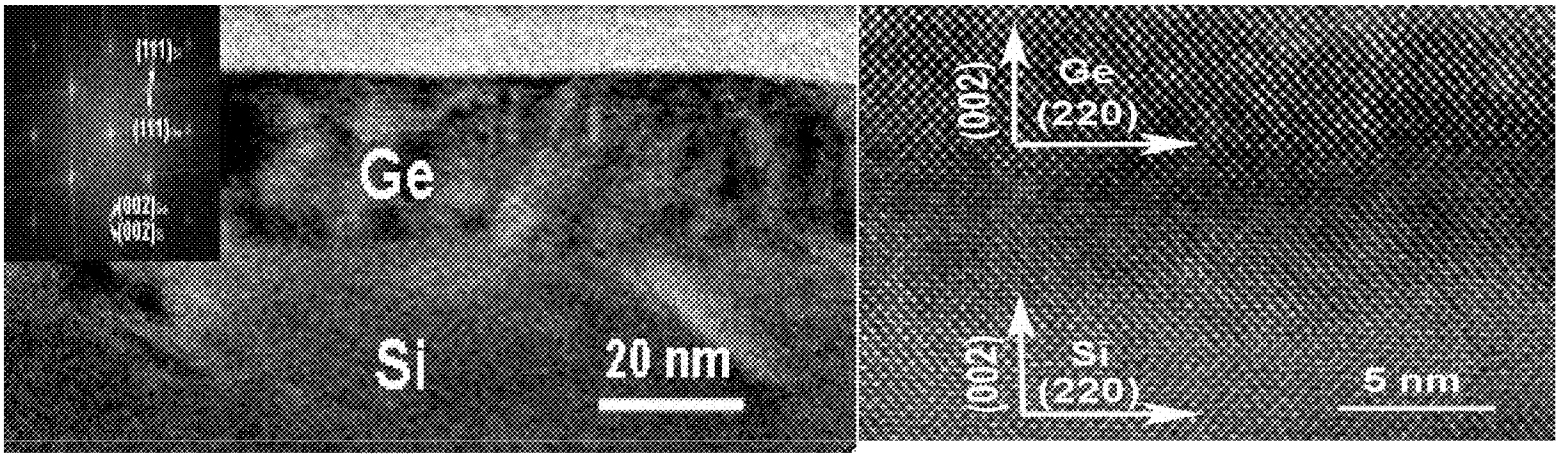
FIGS. 3*a* and 3*b* show transmission electron microscopy ("TEM") images of the microstructure of an highly ordered Ge film and a Si substrate prepared according to an embodiment of the invention.

FIGS. 3*a* and 3*b* show a bright field cross-sectional transmission electron microscopy ("TEM") image and a high resolution TEM ("HRTEM") image, respectively. The images show the interface structure between the highly ordered Ge film and the Si substrate. The bright-field image indicates that the interface between the Ge film and the Si substrate is clean and flat. The thickness of the Ge film is about 25 nm. The inset of FIG. 3*a* shows a fast Fourier transform (FFT) of the interface between Ge and Si. The FFT pattern confirms highly ordered growth of the Ge film on the Si substrate, as evidenced by the distinct diffraction spots from the film and the substrate. The highly ordered relationships between the Ge film and the Si substrate determined from the FFT patterns is consistent with those determined from the XRD patterns. Furthermore, the FFT patterns illustrate the highly ordered growth of single-phase Ge, as diffraction spots from other phases are not observed. The lattice parameter of the highly ordered Ge film calculated from the HRTEM of FIG. 3*b* is 0.567 nm, which is in agreement with the value of 0.566 nm calculated from the XRD measurement.

It is worth noting that, in the past, a thick or graded buffer layer between Ge and Si is usually required to obtain a highly ordered Ge film on a Si substrate. For example, a GeSi buffer layer can be deposited on Si at the expense of creating misfit dislocations, and Ge is deposited thereafter on GeSi. By comparison, Ge films prepared according to this invention are highly ordered even though they are deposited directly on a Si substrate. Without wishing to be bound by any particular explanation, it is believed that the use of polymer in the coating solution plays an important role in the formation of these highly ordered Ge films. It is believed that carbon atoms are present from decomposition of the polyethyleneimine ("PEI") and ethylenediaminetetraacetic acid ("EDTA"). Even though hydrogen, oxygen, and carbon atoms are expected to be carried off by the flowing forming gas during the annealing, it is believed that trace amounts of carbon atoms remain in the Ge films and that the carbon atoms present in the Ge layer facilitates the formation of highly ordered Ge on Si.

Figure 4:
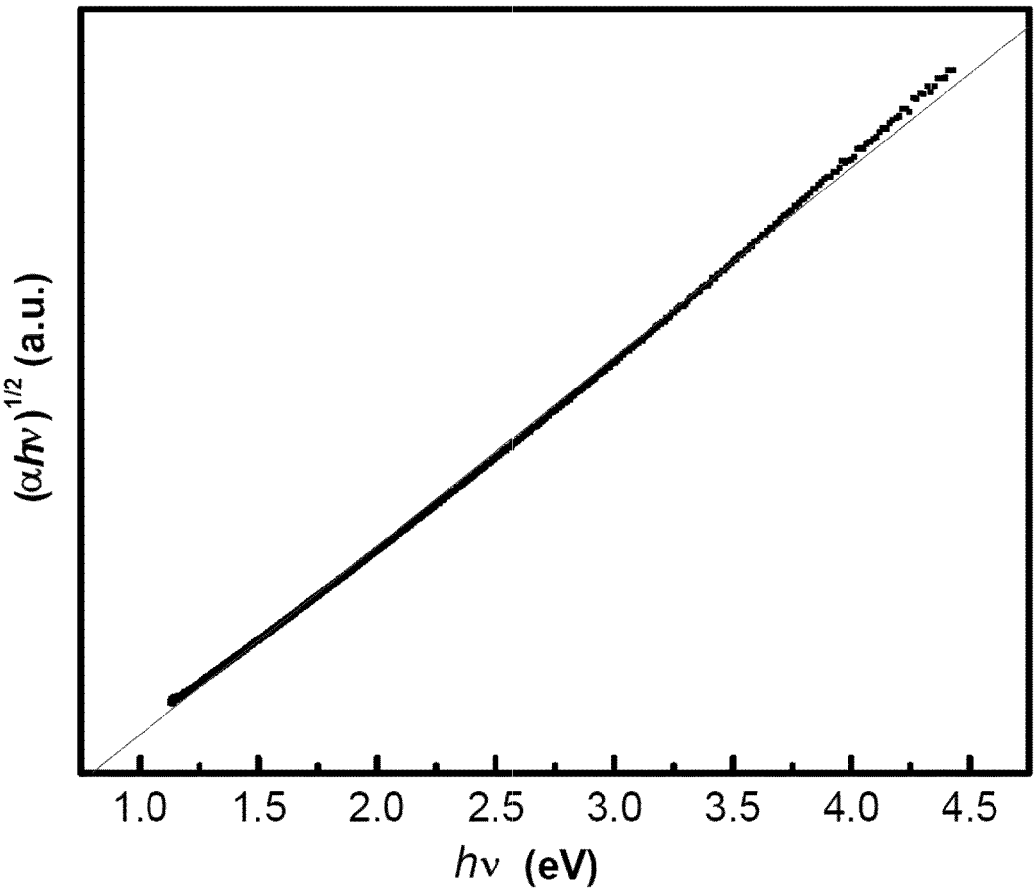
FIG. 4 shows a plot for the determination of optical gaps of highly ordered Ge films prepared according to the invention. The absorption coefficient is a and the photon energy is hv.

FIG. 4 shows a plot for the determination of the optical gap for the highly ordered Ge film. From the FIGURE, the optical gap is estimated to be around 0.79 eV according to Tauc's equation. The result is close to the reported bandgap (0.67 eV) of bulk Ge. The dark curve corresponds to experimental data and the thin line is the curve fit used to obtain the bandgap.

Figure 5:
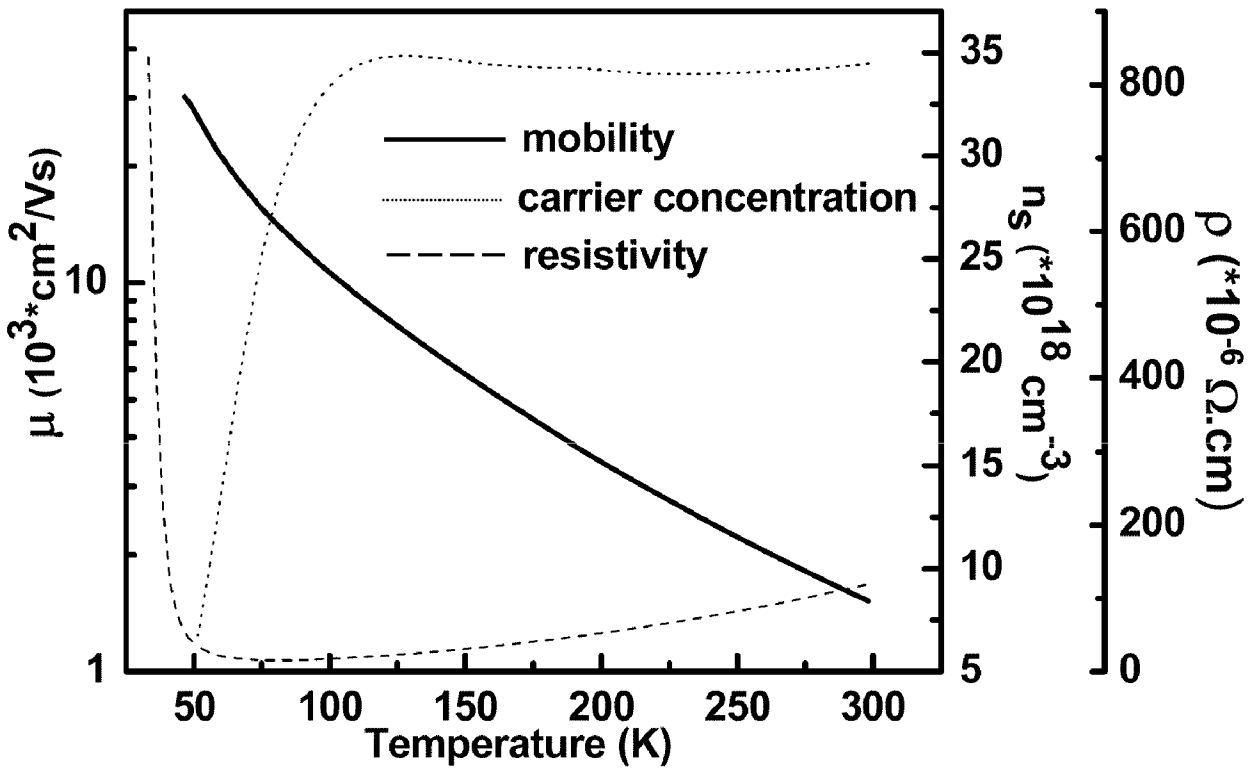
FIG. 5 shows three plots of temperature dependent electrical properties of a highly ordered Ge film on a Si substrate prepared according to an embodiment of the invention. The plot with the left most y-axis labeled "μ" shows the temperature dependence of mobility. The middle plot a y-axis labeled "$n_s$" shows the temperature dependence of the carrier concentration. The last plot, which uses the y-axis on the far right labeled "ρ", shows the temperature dependence of resistivity.

The Hall mobility was measured from 30-300 K by a standard four-probe technique using a QUANTUM DESIGN PHYSICAL PROPERTIES MEASUREMENT SYSTEM ("PPMS"). FIG. 5 shows three plots showing temperature dependent electrical properties of the highly ordered Ge film on the Si substrate. The plot with the left most y-axis of μ shows the temperature dependence of the mobility. The middle plot, which uses the y-axis of $n_s$, shows the temperature dependence of the carrier concentration. The last plot, which uses the y-axis on the right and is labeled as "ρ", shows the temperature dependence of the resistivity. As shown in FIG. 5, the mobility of Ge films can reach up to approximately 1700 $cm^2/Vs$ for carrier concentration of $3.45\times10^{19}$ $cm^{-3}$ at room temperature.

Advantages of the invention for growing highly ordered Ge films include simplicity and reduced cost compared to MBE and CVD, which are the most widely used methods for growing highly ordered Ge films. The invention is simpler and less expensive than these other methods. A high-vacuum apparatus, which is required by both CVD and MBE, is not needed for this invention. Another advantage is that very large highly ordered Ge films may be produced. The invention provides these advantages without sacrificing quality of the highly ordered Ge film. The quality of the Ge films produced using the invention is similar or the same as the quality of highly ordered Ge films produced using other physical vapor deposition techniques.

The following EXAMPLES further illustrate the operability of this invention. EXAMPLES A and B relate to preparation of coating solutions. The remaining examples relate to the preparation of Ge films on substrates. EXAMPLES 1 through 5 relate to preparation of Ge films on single crystal Si substrates. EXAMPLES 6-8 are hypothetical examples of preparing Ge films on substrates other than silicon substrates.

EXAMPLE A

Preparation of a coating solution using germanium oxide: 2.56 grams of $H_2EDTA$ (Aldrich, 99.995%) were dissolved in 25 mL of water. 3.25 g polyethyleneimine ("PEI") (BASF) were then added and mixed to yield a clear solution. 1.20 g of $GeO_2$ (ACROS, 99.999%) were then added. After standing overnight, the result was a clear liquid with some precipitates. The precipitates were removed by filtration using a 0.45 micron filter. The clear solution that remained was placed in an Amicon filtration unit containing a 10,000 molecular weight filter designed to pass materials having a molecular weight<10,000 g/mol. The solution was diluted to 200 mL and then subjected to ultrafiltration, which resulted in reducing the volume to 20 mL for the now concentrated, coating solution. Inductively coupled plasma-atomic emission spectroscopy showed that the coating solution 404 mM Ge. The pH of the solution was 8.44.

EXAMPLE B

Preparation of a coating solution using germanium tetrachloride: 1.3 grams of $H_2EDTA$ (Aldrich, 99.995%) were dissolved in 25 mL of water. 1.6 g PEI (BASF) were then added and mixed to yield a clear solution. 1.20 g of $GeCl_4$ (ACROS 99.999%) were then added slowly. A small amount of precipitate formed. The pH was adjusted to pH 4.9 by dropwise addition of ammonium hydroxide and the solution was allowed to stand overnight. A very small amount of precipitate formed, which was removed by filtering with a 0.45 micron filter. The resulting clear solution was 200 mM in Ge and may be used as a coating solution because the ammonium and chloride ions remaining in the solution may be removed during annealing of the films. Further purification to remove the ammonium chloride was done by placing the solution in an Amicon filtration unit containing a 10,000 molecular weight filter designed to pass materials having a molecular weight<10,000 g/mol. The solution was diluted to 200 mL and then concentrated to 10 mL in volume. Inductively coupled plasma-atomic emission spectroscopy showed that the final solution 344 mM Ge. The pH of the solution was 5.8.

EXAMPLE 1

Si (001) substrates were cleaned using by a 3:1 mixture of concentrated sulfuric acid ($H_2SO_4$) with hydrogen peroxide ($H_2O_2$) for 10 min to remove organic residues from the surface. The silicon was rinsed until the pH of the rinse water was approximately 7. The substrates were dried with dry nitrogen gas and then etched for 30 min in 40% $NH_4F$ and rinsed for 10 min in de-ionized water to remove surface oxides. A precursor solution of example A was then spin-coated on the cleaned Si (001) substrates at 2500 rpm for 20 seconds. The resulting films were heated in forming gas at 900° C. for 3 hours to give highly ordered germanium films with thicknesses of 30-40 nm.

EXAMPLE 2

Several highly ordered germanium films prepared according to the procedure of EXAMPLE 1 were spin coated again, and then heated at 900° C. for 3 hours to give highly ordered germanium films with film thicknesses of 50-60 nm.

EXAMPLE 3

Several Si (111) substrates were cleaned and rinsed to remove organic residues and surface oxides according to the procedure of EXAMPLE 1. A precursor solution of example A was spin-coated on the cleaned Si (111) substrates at 2500 rpm for 20 s. The coated substrates were heated in forming gas at 900° C. for 3 hours to give highly ordered germanium (111) oriented films.

EXAMPLE 4

Several Si(111) substrates with highly ordered germanium films prepared according to the procedure of EXAMPLE 3 were spin coated again and heated at 900° C. for 3 hours. The products were Si(111) substrates with highly ordered Ge (111) films with film thicknesses of 50-60 nm.

EXAMPLE 5

A Si (001) substrate was cleaned to remove organic residues and surface oxides as described in the procedure of EXAMPLE 1. A precursor solution of example A was applied also according to EXAMPLE 1. The resulting coated substrate was heated in an atmosphere of hydrogen gas at 900° C. for 3 hours. Afterward, a second coat of the precursor solution was applied by spin coating. Annealing in hydrogen gas at 900° C. for 3 h gave a 50-60 nm thick germanium coating on the substrate.

In summary, high-quality highly ordered Ge films were prepared on a single crystal Si substrate by applying a solution directly to a surface of the substrate and annealing the solution-coated substrate in a reducing atmosphere containing hydrogen. The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A coating solution useful for preparing highly ordered Ge films, said coating solution prepared by combining water, a germanium compound, ethylenediaminetetraacetic acid, and a polyethyleneimine to form a first solution and thereafter subjecting the first solution to ultrafiltration, thereby forming the aqueous coating solution.

2. The coating solution of claim 1, wherein the germanium compound is germanium oxide, germanium nitrate, germanium fluoride, germanium chloride, germanium bromide, or mixtures thereof.

3. The coating solution of claim 1, wherein the polyethyleneimine is selected from polyethyleneimine and carboxylated polyethyleneimine.

* * * * *